US009681785B2

(12) United States Patent
Kleine-Doepke et al.

(10) Patent No.: US 9,681,785 B2
(45) Date of Patent: Jun. 20, 2017

(54) NOZZLE FOR A VACUUM CLEANER

(71) Applicant: KONINKLIJKE PHILIPS N.V., Eindhoven (NL)

(72) Inventors: Bastian Cornelis Kleine-Doepke, Eindhoven (NL); Bastiaan Johannes De Wit, Eindhoven (NL); Arnoldus Cornelis Wessels, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/902,367

(22) PCT Filed: Mar. 19, 2015

(86) PCT No.: PCT/EP2015/055737
§ 371 (c)(1),
(2) Date: Dec. 31, 2015

(87) PCT Pub. No.: WO2015/150084
PCT Pub. Date: Oct. 8, 2015

(65) Prior Publication Data

US 2017/0007086 A1 Jan. 12, 2017

(30) Foreign Application Priority Data

Mar. 31, 2014 (EP) ..... 14162753

(51) Int. Cl.
*A47L 9/02* (2006.01)
*A47L 9/06* (2006.01)

(52) U.S. Cl.
CPC ..... *A47L 9/02* (2013.01); *A47L 9/0606* (2013.01)

(58) Field of Classification Search
CPC ..... A47L 9/02; A47L 9/0606
(Continued)

(56) References Cited

U.S. PATENT DOCUMENTS 2,241,775 A 5/1941 Forsberg
2,276,943 A 3/1942 Dow

FOREIGN PATENT DOCUMENTS

DE 19829044 A1 1/2000
DE 202012005866 U1 7/2012
(Continued)

OTHER PUBLICATIONS

EU Commission's Delegated Regulation (EU) No. 665/2013 on energy labelling of vacuum cleaners, May 3, 2013, Official Journal of the European Union, L192/1-L192/23.

*Primary Examiner* — David Redding

(57) ABSTRACT

The present invention relates to a nozzle (1) for a vacuum cleaner. The nozzle (1) has a base (3) having an edge (4, 5) and a suction aperture (11) in the base (3). At least one flexible flap (24, 26) protrudes from the base (3) between the edge (4, 5) and the suction aperture (11). The flexible flap (24, 26) has first and second sections (32, 33) separable by an opening (35). The first and second sections (32, 33) are urged towards each other when the nozzle (1) is moved in a first direction in which the edge (4, 5) is a leading edge to close the opening (35) or tend the opening (35) towards closure, and the first and second sections (32, 33) are biased away from each other when the nozzle (1) is moved in a second direction in which the edge (4, 5) is a trailing edge to open the opening (35) or to further open the opening. The present invention also relates to a vacuum cleaner comprising a nozzle (1) for a vacuum cleaner.

15 Claims, 5 Drawing Sheets

(58) Field of Classification Search
USPC ..... 15/401, 416, 418, 420
IPC ..... A47L 9/02
See application file for complete search history.

(56) References Cited

FOREIGN PATENT DOCUMENTS

| | | | |
|---|---|---|---|
| EP | 1314388 | A1 | 5/2003 |
| EP | 2457481 | A1 | 5/2012 |
| GB | 1071858 | A | 11/1963 |
| JP | 60055351 | U1 | 9/1973 |
| JP | 09010147 | A | 1/1997 |
| WO | 2008028759 | A1 | 3/2008 |
| WO | 2009133031 | A1 | 11/2009 |

NOZZLE FOR A VACUUM CLEANER

This application is the U.S. National Phase application under 35 U.S.C. §371 of International Application No. PCT/EP2015/055737, filed Mar. 19, 2015, which claims the benefit of International Application No. 14162753.9 filed on Mar. 31, 2014. These applications are hereby incorporated by reference herein.

FIELD OF THE INVENTION

The present invention relates to a nozzle for a vacuum cleaner.

BACKGROUND OF THE INVENTION

Vacuum cleaners are commonplace in households and places of work. Vacuum cleaners are generally used to remove detritus, such as food, dirt, and hair, from a surface, such as a floor. A common type of vacuum cleaner generally comprises a motor that drives a fan which sucks air through a suction aperture in a maneuverable nozzle which causes a decrease in pressure at the surface to be cleaned. Air is drawn along the surface to be cleaned and into the suction aperture carrying detritus which is transported into a collection vessel for removal.

Many vacuum cleaners include brush elements which protrude from the base of the nozzle. As the shape and size of the detritus varies from small dust particles to larger pieces of food, it is common to provide spaces between the brush elements to allow detritus to pass the protrusions and enter the vacuum cleaner.

It is known to provide a nozzle for a vacuum cleaner with V-shaped protrusions, configured to guide detritus towards the suction aperture, in order to prevent detritus being pushed in front of the vacuum cleaner. Such arrangements can be found in WO2009/133031. However, V-shaped protrusions are inherently rigid and so result in poor performance on uneven surfaces, such as tiles and wood floors, and an uncomfortable/unpleasant experience for the user. Furthermore, V-shaped protrusions form a recess in which detritus that has not been transported to the collection vessel collects. Therefore, the user is unaware that the nozzle has not removed all the detritus from the surface to be cleaned until the nozzle is removed from the surface.

SUMMARY OF THE INVENTION

It is an object of the invention to provide a nozzle for a vacuum cleaner which substantially alleviates or overcomes the problems mentioned above. The invention is defined by the independent claims; the dependent claims define advantageous embodiments.

According to one aspect of the present invention, there is provided a nozzle for a vacuum cleaner comprising a base having an edge, a suction aperture in the base, and at least one flexible flap protruding from the base between the edge and the suction aperture, the flexible flap having first and second sections separable by an opening, the first and second sections being urged towards each other when the nozzle is moved in a first direction in which the edge is a leading edge to close the opening or tend the opening towards closing, the first and second sections being urged away from each other when the nozzle is moved in a second direction in which the edge is a trailing edge to open the opening or further open the opening.

The above arrangement helps to ensure that detritus does not become trapped behind the flexible flap when the nozzle is moved in the second direction. The opening of the flexible flap allows an air flow or increased air flow to pass between the first and second sections of the flexible flap and to help remove lighter detritus from the recess whilst allowing heavier detritus that is not removed from the surface to be cleaned to exit the nozzle. Detritus may also pass through the opening in the flexible flap and exit the nozzle by the opening or the increase of the size of the opening. Therefore, a user can tell whether all the detritus on the surface to be cleaned has been drawn through the suction opening. Furthermore, the opening is closed or minimized when the nozzle is moved in the first direction so that the open area along the edge is reduced and the suction under the base is maximized.

Furthermore, closing the opening between the first and second section of the flexible flap when the nozzle is moved in the first direction is advantageous because detritus cannot get stuck in the small opening that remains when the first and second sections are only tended towards closing. Therefore, the air flow and detritus flow along an outer face of the flexible flap instead of getting stuck in a narrow opening.

In one embodiment, the inventive measure that the first and second sections of the flexible flaps are urged towards each other when the nozzle is moved in a first direction in which the edge is a leading edge to close the opening or tend the opening towards closing, and urged away from each other when the nozzle is moved in a second direction in which the edge is a trailing edge to open the opening or to further open the opening, is caused by the combined facts that the flaps are flexible and that their height exceeds a distance between the base and a surface to be cleaned.

The first and second sections of the flexible flap may be configured to guide detritus towards the suction aperture when the nozzle is moved in the first direction. Therefore, the detritus is not pushed along the surface to be cleaned in front of the nozzle by the flexible flaps. Instead, the detritus is able to enter the nozzle.

The flexible flap may be configured to define a recess on a rear side facing the suction aperture. Therefore, in this embodiment detritus that has not been lifted from the surface to be cleaned by the nozzle may collate in the recess and be removed when the sections are opened or the size of the opening is increased.

A raised section of the base is received in the recess, spaced from the flexible flap. Therefore, the volume of free space under the nozzle is minimized. This helps to maximize the vacuum formed under the nozzle, and therefore the suction capabilities of the nozzle. Furthermore, the rotational, turbulent flow behind the flap may be minimized. Therefore, the noise level of the nozzle and a rise in pressure of the air flow in the nozzle may be minimized.

The first and second sections of the flexible flap may diverge away from each other from the edge. With this arrangement the flexible flap helps to guide detritus along the faces of the flexible flap towards the suction aperture.

A stop may limit movement of the first and second sections when the nozzle is moved in one direction. The stop may be formed by the first and second sections being urged against, and acting against, each other when the nozzle is moved in one direction.

The stop may be opening side edges of the first and second sections of the flexible flap which may be configured to arc away from each other at free ends of the sections so that when the nozzle is moved in the first direction the sections flex towards the rear edge of the base and the opening side edges abut to close the opening.

The stop reduces likelihood of detritus urging the flexible first and second sections into a position where the flexible flap is no longer in contact with the floor. The stop also reduces the likelihood that, or the extent to which, the high negative pressure pulls the flexible flaps off the surface to be cleaned towards the suction opening. The configuration of the abutting opening side edges helps to prevent the flexible flap from being lifted from the surface to be cleaned at the point where the side edges meet. Therefore, detritus cannot pass under the first and second sections and is guided along the faces of the flexible flap towards the suction aperture. The flexible flap maintaining contact with the floor enables the vacuum cleaner to maintain a high negative pressure and therefore, high performance.

The first and second sections may tend away from a vertex of the flexible flap. The opening may be defined at the vertex. Therefore, when the nozzle is moved in the second direction, detritus on the rear side of the flexible flap is guided towards the opening. Furthermore, it will be understood that the movement of the sections will be limited when the nozzle is drawn in one direction due to the vertex edges of each section abutting and acting against each other. This helps to ensure that the sections are only able to distend away from each other when the nozzle is moved in one direction and are prevented from distending away from each other when the nozzle is moved in the opposite direction to prevent or limit the size of the opening in the opposite direction.

The opening may comprise a slit or slot between the first and second sections. Therefore, the opening may be easily formed.

The slit may be configured such that the first and second sections are discrete elements. Therefore, the resistance to bending of the first and second section may be reduced, and performance enhanced on uneven floors.

The nozzle may further comprise a guide arrangement configured to space the base from a surface to be cleaned. The guide arrangement helps to prevent the base from being drawn into abutment with the surface to be cleaned and aids movement of the nozzle across the surface to be cleaned easily. This arrangement allows for a predetermined spacing between the base of the nozzle and the surface to be cleaned.

The height of the at least one flexible flap from the base to a distal end of the flexible flap may be greater than the spacing provided by the guide arrangement so that, during use, the at least one flexible flap is in contact with the surface to be cleaned. Therefore, the sections are urged to distend away from their neutral position into other positions dependent on the direction in which the nozzle is drawn.

The nozzle may comprise an array of flexible flaps. Adjacent flexible flaps may be spaced from each other.

An inlet may be defined between adjacent flexible flaps. Two or more inlets may be defined.

Having an array of flexible flaps allows the nozzle to increase the resistance to the flow into the nozzle and helps to ensure that a high vacuum is generated in the nozzle.

The array of flexible flaps may be a first array of flexible flaps disposed on one side of the suction aperture and a second array of flexible flaps may be disposed on an opposing side of the suction aperture. This provides for cleaning performance on both sides of the suction aperture when the nozzle is moved in both the first direction and the second direction.

Each inlet defined between adjacent flexible flaps may be offset from each other or misaligned. The arrangement of the flexible flaps helps to prevent air and detritus that has entered through one inlet flowing out through another inlet. The offset arrangement helps to prevent a clean line of sight for air and detritus between inlets. The flexible flaps are arranged so another flexible flap is impinged before air and detritus can exit the nozzle. By impinging another flexible flap the air and detritus is guided back towards the suction opening and therefore, cannot exit the nozzle, which increases the performance of the nozzle.

The first and second sections of the flexible flap may be asymmetric. Therefore, the width of the first and second sections of the flexible flap can be different so that at least one section can be elongated to prevent clear line of sights between inlets.

The base may have a primary air channel configured to guide detritus towards the suction aperture and a secondary air channel having a juncture with the primary air channel which is configured to guide detritus from the edge of the base to the primary air channel. Air channels help to guide the air flow entering from the edge of the nozzle to the suction aperture. Air channels help to reduce the amount that air flow entering impinges with other air flow. Therefore, air channels may aid in reducing turbulence.

The nozzle may comprise two or more flexible flaps, wherein adjacent flexible flaps may define an inlet to the secondary air channel. Therefore, detritus and air flow is guided towards the air channel to aid pick-up of detritus.

The primary air channel may have a first part and a second part, the second part being defined between the suction aperture and the juncture of the first part, and wherein the flow area of the second part of the primary air channel is greater than the flow area of the first part.

By increasing the area of the primary channel after the junction a pressure increase may be avoided in the primary air channel which enables the nozzle to maintain a high negative pressure in the nozzle and therefore, high performance.

During use, the secondary air channel may be configured to guide a flow of air along the secondary air channel to impinge with a flow of air along the primary air channel at an acute angle at the juncture of the primary and secondary air channels to promote laminar flow.

According to another aspect of the present invention, there is provided a nozzle for a vacuum cleaner comprising a base having an edge, a suction aperture in the base, the base having a primary air channel configured to guide detritus towards the suction aperture, and a secondary air channel having a juncture with the primary air channel which is configured to guide detritus from a periphery of the base to the primary air channel.

Air channels help to guide the air flow entering from the edge of the nozzle to the suction aperture. Air channels help to reduce the amount that air flow entering impinges with other air flow. Therefore, air channels may aid in reducing turbulence.

Adjacent flexible flaps may define an inlet to the secondary air channel. Therefore, the flexible flaps are able to help guide air flow and detritus directly into the secondary air channel.

A raised section of the base may define the primary and secondary air channels. Therefore, the air channels may be easily formed. The secondary air channels may be offset from each other or misaligned. The arrangement of the secondary air channels helps to prevent air and detritus that passes along one secondary air channel from flowing out through another secondary air channel. The offset arrangement helps to prevent a clean line of sight for air and detritus between secondary air channels.

The height of the raised section may be less than the height of each flexible flap.

The primary air channel may have a first section and a second section, the second section being defined between the juncture of the first section and the suction aperture, the flow area of the second section of the primary air channel being greater than the flow area of the first section.

The flow area of the second section of the primary air channel may correspond to the combined flow areas of the secondary air channel and the first section of the primary air channel.

The primary air channel may have a first section and a second section, the second section being defined between the juncture of the first section and the suction aperture, the flow area of the second section of the primary air channel being greater than the flow area of the first section.

The flow area of the second section of the primary air channel may correspond to the combined flow areas of the secondary air channel and the first section of the primary air channel.

Advantageously, the cross-sectional area increases proportionally to the cross-sectional area of the guide channel that it meets at the junction. The increase in flow area matches the increase in mass flow of air due to the addition of the mass flow in the guide channel to the main air channel mass flow. By increasing the flow area, the nozzle is able to maintain the same high negative pressure in the main channel which means that constant performance is achieved throughout the nozzle.

During use, the secondary air channel may be configured to guide a flow of air along the secondary air channel to impinge with a flow of air along the primary air channel at an acute angle at the juncture of the primary and secondary air channels to promote laminar flow.

By aligning the air flow in the secondary air channel with the air flow in the primary air channel, the amount of mixing of the two air flows can be reduced. Therefore, the turbulence caused may be reduced. This helps to reduce the noise produced by the nozzle and increase performance.

The nozzle may comprise two or more secondary air channels which are offset from one another.

Advantageously, the arrangement of the secondary air channels helps to prevent air and detritus that passes along one secondary air channel from flowing out through another secondary air channel. The offset arrangement helps to prevent a clean line of sight for air and detritus between secondary air channels.

According to another aspect of the present invention, there is provided a vacuum cleaner comprising a nozzle according to the invention.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
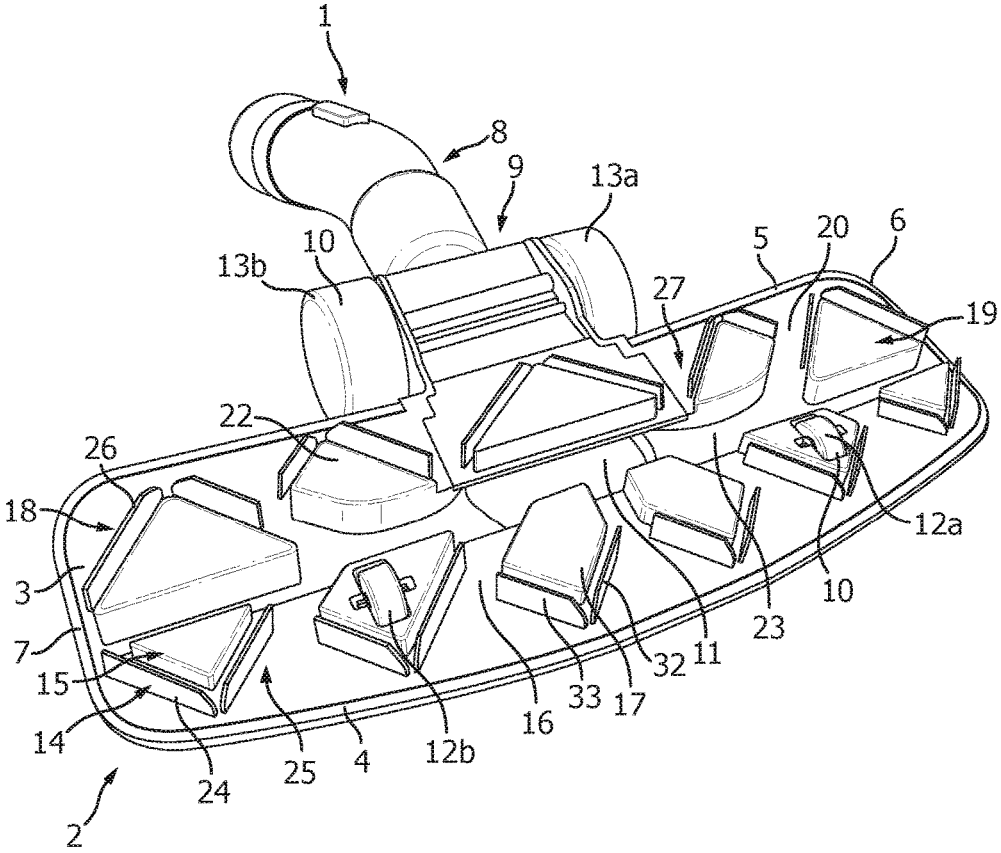
FIG. 1 shows a schematic bottom view of an embodiment of a nozzle for a vacuum cleaner.

Referring to FIG. 1, there is shown a nozzle 1 for a vacuum cleaner (not shown). The vacuum cleaner is configured to remove detritus, such as food, dirt, and hair, from a surface to be cleaned (not shown). Surfaces to be cleaned include, but are not limited to, hard floors, such as hard wood flooring, or planks, and tiles.

A vacuum cleaner may have different configurations, for example, an upright vacuum cleaner, or a handheld vacuum cleaner.

The nozzle 1 comprises a body 2 having a base 3. The base 3 forms the underside of the body 2. The base 3 is disposed proximate to a surface to be cleaned when the nozzle 1 is in use. The nozzle 1 for a vacuum cleaner is fluidly connectable to a suction unit (not shown) via a suction hose, although it will be understood that alternative arrangements are possible. For example, the suction unit (not shown) may be mounted to an upper end of the body 2.

In the present embodiment, the base 3 has front and rear edges 4, 5. The front edge 4 opposes the rear edge 5. The front edge 4 has a convex profile. However, it will be understood that the front edge 4 may have an alternative configuration, for example linear. The rear edge 5 has a concave profile. However, it will be understood that the rear edge 5 may have an alternative profile, for example linear.

Side edges 6, 7 extend between the front and rear edges 4, 5. The side edges 6, 7 converge towards each other between the front and rear edges 4, 5. However, it will be understood that the side edges 6, 7 may have an alternative profile. Left and right sides of the base 3 are generally symmetrical about a center line defining a line of symmetry A-A (refer to FIG. 4).

A guide unit 9 extends from the rear end of the body 2. The guide unit 9 extends from the rear edge 5 of the base 3. An elongate handle (not shown) extends from the guide unit 9. The elongate handle is connected to the nozzle 1 by a pivot joint 8. The pivot joint 8 allows the nozzle 1 to pivot relative to the elongate handle.

The vacuum cleaner will further comprises a suction unit comprises a vacuum pump (not shown), a detritus collection vessel (not shown), for example a detritus chamber and a filter, and an air outlet (not shown). Such an arrangement is conventional and so a detailed description will be omitted herein. A suction hose (not shown) is fluidly connected to the suction unit in the body unit to generate suction in the nozzle 1. The suction outlet communicates with a suction aperture 11 in the base 3 of the nozzle 1 through which detritus is drawn into the nozzle 1.

It will be understood that alternative arrangements are possible. For example, the suction unit (not shown) may be in the nozzle 1. Furthermore, the elongate handle (not shown) and suction hose (not shown) may be integrated, or the vacuum cleaner may be integrated into an upright configuration.

The suction aperture 11 is formed by an aperture formed in the base 3 of the nozzle 1. The suction aperture 11 is disposed midway between the front and rear edges 4, 5. The suction aperture 11 is disposed midway between the side edges 6, 7. The suction aperture 11 is elongate and extends generally parallel to the front and rear edges 4, 5. It will be understood that the suction aperture 11 may have a different configuration. For example, the suction aperture 11 may be formed by two or more apertures, and/or have a different shape. For example, the shape of the suction aperture 11 may include rectangular, circular or elliptical.

The nozzle 1 has a guide arrangement 10 to space the base 3 from the surface to be cleaned. That is, the guide arrangement 10 is configured to maintain the base 3 at least a predefined distance from the surface to be cleaned. The guide arrangement 10 prevents the base 3 from being drawn against the surface to be cleaned by suction. The guide arrangement 10 comprises a front wheel unit 12 disposed proximate to the front edge 4 of the base 3, and a rear wheel unit 13 disposed proximate to the rear edge 5 of the base 3. In the present embodiment, the rear wheel unit 13 is on the guide unit 9. The front and rear wheel units 12, 13 are spaced from each other to provide stability to the nozzle 1 on the surface to be cleaned. It will be understood that the suction will draw the base 3 towards the surface to be cleaned, but that the guide arrangement 10 will maintain a minimum spacing between the base 3 and the surface to be cleaned. In the present arrangement, the front wheel unit 12 has two wheels 12*a*, 12*b*, and the rear wheel unit 13 has two wheels 13*a*, 13*b*, however it will be understood that the number of wheels may vary. It will also be understood that the guide arrangement 10 may have another arrangement, for example, but not limited to, sliders.

A first array of flexible flaps 14 extends from the base 3. The first array of flexible flaps 14 is arranged along the front edge 4 of the base 3. The first array of flexible flaps 14 is disposed proximate to, but spaced from, the front edge 4. The first array of flexible flaps 14 is disposed on one side of the suction aperture 11.

A first raised section 15 extends behind the first array of flexible flaps 14. The first raised section 15 extends substantially between the first array of flexible flaps 14 and the suction aperture 11.

The first raised section 15 protrudes from a lower surface. Air channels 16 are formed in the first raised section 15, such that channels are defined in the base 3. The air channels 16 divide the first raised section 15 into protruding islands 17. The air channels 16 define passageways along which detritus may pass from a periphery of the base 3 to the suction aperture 11. However, it will be understood that the air channels 16 and the first raised section 15 may be omitted.

A second array of flexible flaps 18 extends from the base 3. The second array of flexible flaps 18 is arranged along the rear edge 5 of the base 3. The second array of flexible flaps 18 is disposed proximate to, but spaced from, the rear edge 5. The second array of flexible flaps 18 is disposed on one side of the suction aperture 11. The second array of flexible flaps 18 is disposed on an opposite side of the suction aperture 11 to the first array of flexible flaps 14.

A second raised section 19 extends behind the second array of flexible flaps 18. The second raised section 19 extends substantially between the second array of flexible flaps 18 and the suction aperture 11. The second raised section 19 protrudes from the lower surface. The second raised section 19 is disposed on an opposite side of the suction aperture 11 to the first raised section 15. Air channels 20 divide the second raised section 19 into protruding islands 22. The air channels 20 are formed in the second raised section 19 so as to be formed in the base 3. The air channels 20 define passageways along which detritus may pass from a periphery of the base 3 to the suction aperture 11. However, it will be understood that the air channels 20 and the second raised section 19 may be omitted.

A primary air channel 23 is formed by the base 3. The primary air channel 23 which extends in the base is formed between the first and second raised sections 15, 19. The first raised section 15 and the second raised section 19 are spaced from each other. The primary air channel 23 fluidly communicates with the suction aperture 11. The primary air channel 23 guides the air flow from the air channels 16, 20, acting as secondary air channels, to the suction aperture 11.

The first array of flexible flaps 14 comprises six flexible flaps 24. However, it will be understood that the number of flexible flaps 24 may vary. Each flexible flap 24 is spaced from the front edge 4 by the same distance in the present embodiment, however it will be understood that adjacent flexible flaps 24 may be spaced from the front edge 4 by differing distances. Each flexible flap 24 is spaced from adjacent flexible flaps 24. An inlet 25 is formed between adjacent flexible flaps 24.

The second array of flexible flaps 18 comprises five flexible flaps 26. However, it will be understood that the number of flexible flaps 26 may vary. Each flexible flap 26 is spaced from adjacent flexible flaps 26. An inlet 27 is formed between adjacent flexible flaps 26.

The first array of flexible flaps 14 is configured such that the inlets 25 located between adjacent flexible flaps 24 in the array 14, are offset from the inlets 27 located between adjacent flexible flaps 26 in the second array of flexible flaps 18. The configuration of the offset flexible flaps 24, 26 prevents air flow and detritus that enters the nozzle 1 through one inlet 25, 27 having a clear line of sight to another inlet 25, 27 through which the air flow or detritus may be ejected. The offset configuration of the flexible flaps 24, 26 prevents air flow and detritus from exiting the nozzle 1 because air flow and detritus is either transported straight to the suction aperture 11 or impinges another flexible flap 24, 26 before being sucked into the suction aperture 11.

Figure 2:
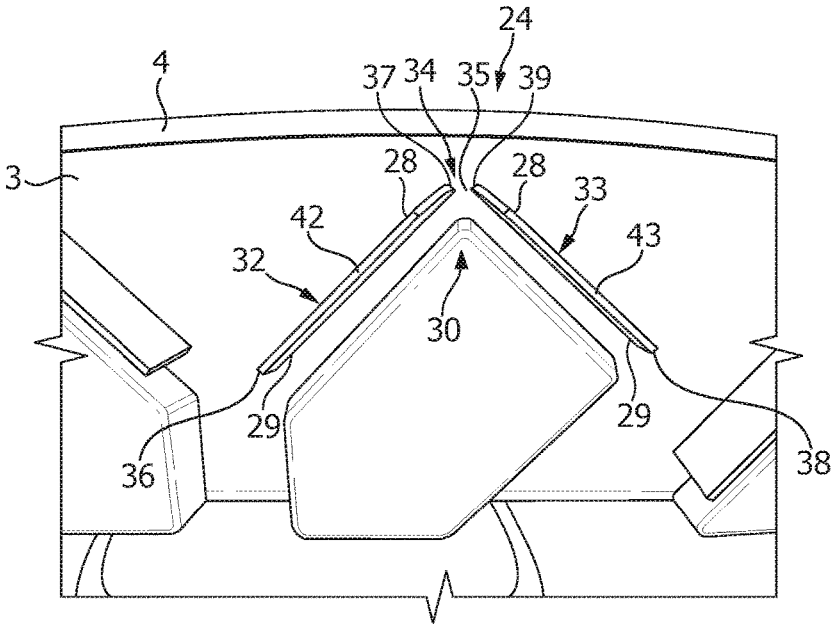
FIG. 2 shows a schematic bottom view of a flexible flap and island on a base of the nozzle.
Figure 3:
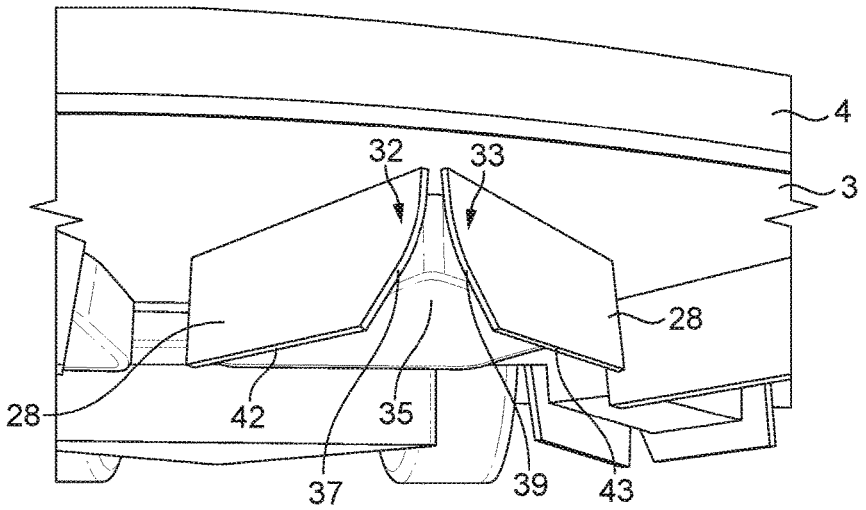
FIG. 3 shows a schematic front view the flexible flap protruding from the base.

Referring in particular to FIGS. 2 and 3, one of the flexible flaps 24, 26 is shown. Each flexible flap has generally the same arrangement and so a detailed description will be omitted. The flexible flap 24 is disposed between the suction aperture 11 and the front edge 4 of the base 3. The flexible flap 24 protrudes downwardly from the base 3. The flexible flap 24 extends vertically; alternatively the flexible flap 24 may protrude from the base 3 at an angle to the vertical. The flexible flap 24 protrudes from a lower surface of the base 3. The flexible flap 24 is resilient. The flexible flap 24 is able to flex when it comes into contact with a protruding part of the surface to be cleaned. The flexible flap 24 is resilient so that it can deform and then return to its original shape.

In one embodiment, the flexible flap 24 is a rigid flap which is flexibly mounted to the base 3 by, for example, but not limited to, a hinge.

The flexible flap 24 comprises an outer face 28 defining a front side and an inner face 29 defining a rear side. The outer face 28 of the flexible flap 24 is proximate to the front edge 4 of the base 3. The inner face 29 of the flexible flap 24 faces the suction aperture 11. The rear side defines a recess 30. Detritus that has not been lifted from the surface to be cleaned may collate in the recess 30.

The flexible flap 24 is V-shaped. The flexible flap 24 has first and second sections 32, 33 diverging away from each other. The flexible flap 24 has a vertex 34, and the first and second sections 32, 33 diverge away from each other from the vertex 34. The angle between the first and second sections is between 30 degrees and 150 degrees. Alternative profiles are possible. For example, the flexible flap 24 may have an arcuate profile. The first and second sections 32, 33 may be arced.

The flexible flap 24 has an opening 35. The opening 35 extends from the outer face 28 to the inner face 29 of the flexible flap 24. The opening 35 divides the flexible flap 24 into the first section 32 and the second section 33. The first section 32 of the flexible flap 24 has a linear profile. The second section 33 of the flexible flap 24 has a linear profile. The linear profiles minimize resistance to flexing. However, it will be understood that the first and second sections 32, 33 of the flexible flap 24 may have an alternative configuration, for example, but not limited to, an arcuate profile.

As shown in FIGS. 1 to 5, the opening 35 spaces the first section 32 from the second section 33 of the flexible flap 24 at the upper end. This allows the size of the opening to be maximized. The opening 35 is configured to allow air flow to leak into the recess 30 formed by the inner face 29 of the flexible flap 24. When the velocity of the air flow is high enough, detritus that is received in the recess 30 is removed from the recess 30 and surface to be cleaned. Detritus is also able to exit the recess 30 and nozzle 1 through the opening 35.

In another embodiment, the opening 35 is a slit. In this embodiment, the first and second sections 32, 33 abut each other or are integrally formed at the upper end. This limits airflow from leaking through the opening 35 when the nozzle 1 is moved in a first direction.

The first section 32 of the flexible flap 24 has a free side edge 36 distal to the opening 35 and an opening side edge 37 at the opening 35. The second section 33 of the flexible flap 24 has a free side edge 38 distal to the opening 35 and an opening side edge 39 formed by the opening 35. The opening side edges 37, 39 align with each other. The first and second sections 32, 33 are separable by the opening 35. The first and second sections 32, 33 are each flexible.

The first and second sections 32, 33 have a height which extends from the base 3 towards the surface to be cleaned, a width, and a thickness. It will be understood that these parameters may be any size necessary as determined by a person skilled in the art. The first and second sections 32, 33 may have differing heights, widths, and/or thickness.

In the present embodiment, the flexible flap 24 has a thickness of 1 millimeter (mm). However, the thickness of the and each flexible flap 24 may vary. The flexible flap 24 has a uniform thickness, however this may vary, for example, the thickness of the flexible flap 24 may be tapered from the base end to the free end 42, 43. The thickness of the flexible flap 24 may be between 0.5 mm and 2 mm.

Furthermore, in the present embodiment, the flexible flap 24 has a height of 10.5 mm. The guide arrangement 10 spaces the base 3 of the nozzle 1 from the surface to be cleaned by 10 mm. Therefore, the flexible flap 24 has an exposure of 0.5 mm on the surface to be cleaned. However, the height of the flexible flap may vary and is dependent on the distance at which the guide arrangement 10 spaces the base 3 from the surface to be cleaned and the exposure the flexible flap 24 has on the surface. The height of the flexible flap 24 may be between 5 mm and 20 mm.

In one embodiment, the width of the flexible flap 24 varies depending on its position relative to the suction aperture 11. The width of the flexible flap 24 may also be varied to ensure that there is no clean line of sight between inlets 25, 27, so that detritus that enters one of the inlets 25 on one side of the nozzle 1 cannot pass directly through one of the inlets 27 on the other side of the nozzle 1. The length of the flexible flap 24 may be between 20 mm and 40 mm.

Each of the first and second sections 32, 33 has a free end 42, 43. The free end 42, 43 of each section 32, 33 is at a distal end. The opening side edges 37, 39 of the first and second sections 32, 33 of the flexible flap 24 arc away from each other towards the free ends 42, 43 of the flexible flap 24. The opening side edges 37, 39 are configured to abut against each other when the nozzle 1 is moved in the first direction.

Outer faces 28 of first and second sections 32, 33 of the flexible flap 24 are configured to guide detritus towards the inlet 25 between adjacent flexible flaps 24, and therefore to the air channel 20 when the nozzle 1 is moved in the first direction. This means that detritus is able to enter the nozzle 1 rather than being swept along in front of the nozzle 1. For the first array of flexible flaps 14, the first direction is a direction in which the front edge 4 is the leading edge.

In the present embodiment, as shown in FIG. 3, the opening 35 is formed by an aperture between the first and second sections 32, 33. In this embodiment, the first and second sections 32, 33 are discrete. The aperture extends the full height of the flexible flap 24 to the lower surface of the base 3. The aperture slightly spaces the first section 32 from the second section 33 of the flexible flap 24. Therefore, the first section 32 and the second section 33 do not abut each other in an unbiased position.

However, it will be understood that alternative arrangements are envisaged. For example, the first and second sections 32, 33 may be integrally formed. The aperture may extend only partially along the height of the flexible flap 24 from the free ends 42, 43.

In this alternative embodiment, the first and second sections 32, 33 may be connected at an upper end of the flexible flap 24 by a connecting section (not shown). The aperture may be configured so that the connecting section of the flexible flap 24 protrudes from the base 3.

In another alternative embodiment, it will be understood that the opening 35 is formed by a slit. In such an arrangement the slit may extend the length of the flexible flap 24 or only partially therealong from the free ends 42, 43. It will be understood that the flexible flap 24 may comprise more than one opening.

As shown in FIG. 2, the flexible flap 24 is configured such that the first section 32 extends at an angle to the second section 33. The angled first and second sections 32, 33 help to guide detritus towards the suction aperture 11 when the nozzle 1 is moved in the first direction and help to guide detritus that has not been removed from the surface to be cleaned out from under the nozzle 1 when the nozzle 1 is moved in a second direction. For the first array of flaps 14, the second direction is a direction in which the front edge 4 of the base 3 is the trailing edge. Both the first section 32 and the second section 33 extend at an angle relative to the front edge 4 of the base 3.

The first section 32 and second section 33 extends at an angle relative to the front edge 4 so that the vertex 34 is proximate to the front edge 4. The opening 35 is formed at the vertex 34. The opening 35 formed at the vertex 34 ensures that detritus is not retained in the recess 30 defined by the first and second sections 32, 33.

The opening 35 formed at the vertex 34 divides the V-shaped flexible flap 24 into separate first and second sections 32, 33. This increases the flexibility of the flexible flap 24. By having the first and second sections 32, 33 separated at the vertex, the stiffness of the flexible flap 24 is reduced which minimizes the chance of the flexible flap 24 being damaged by protrusions from uneven surfaces. The opening 35 increases the flexibility of the flexible flap 24. Therefore, the flexible flap 24 can adapt to uneven surfaces which in turn helps the nozzle 1 to provide high performance on the surfaces to be cleaned and may increase product life by preventing excessive wear of the flexible flaps 24.

In the present embodiment, shown in FIG. 2, the first and second sections 32, 33 are perpendicular to each other. That is, the angle formed between the first section 32 and the second section 33 is 90 degrees. The first and second sections 32, 33 extend at an angle of 45 degrees relative to the first direction in which the nozzle 1 is moved. The first and second section 32, 33 extend at equal but opposite angles to the first direction of movement However, it will be understood that the flexible flap 24 may have alternative arrangements. For example, the first and second sections 32, 33 of the flexible flap 24 may extend at different angles relative to the first direction in which the nozzle 1 is moved. The angle that the first section 32 makes relative to the first direction of movement may be different to the angle that the second section 33 makes with the first direction of movement.

Furthermore, the flexible flaps 24, 26 within each array of flexible flaps 14, 18 may have differing configurations. In one embodiment, the angle of the first and second sections 32, 33 may be reduced, relative to the first direction of movement, as the distance between the suction aperture 11 and the flexible flap 24 increases. Air flow into the nozzle 1 encounters the least resistance to motion closest to the suction aperture 11. Therefore, a lower airflow is experienced further away from the suction aperture 11 and so the angle of the first and second sections 32, 33 of the flexible flaps 24 in an array 14, 18 relative to the first direction of movement can be varied to improve performance of the nozzle 1. The performance at the distal ends of the nozzle 1 can be improved because the airflow encounters less resistance from the flexible flap 24 due to the smaller frontal cross-sectional area of the flexible flap 24.

The performance of the nozzle 1 is also increased because the reduced angle of the first and second sections 32, 33 relative to the first direction of movement makes it easier for detritus to slide along the outer face 28 of the flexible flap 24 towards the suction aperture 11. The larger the angle of the first and second sections 32, 33 relative to the first direction of movement, the more likely it is that detritus is pushed along in front of the nozzle 1. To overcome the effect of larger angles a larger airflow must pass the flexible flap 24. Therefore, the flexible flaps 24 are configured so that the angle of the first and second sections 32, 33 relative to the first direction of movement becomes smaller with increasing distance from the suction aperture 11 to make it easier for detritus to pass the flexible flap 24 under the influence of a lower airflow.

The airflow around the flexible flap 24 is determined by its proximity to the suction aperture 11. The section 32, 33 which is closest to the suction aperture 11 will receive the largest portion of airflow along it. The further away the section 32, 33 of the flexible flap 24 from the suction aperture 11, the lower the airflow along it.

The height of the flexible flap 24 from the upper end which protrudes from the base 3 to the lower end is greater than the spacing provided by the guide arrangement 10. This ensures that the flap 24 remains in contact with the surface to be cleaned even when the surface is uneven. The first and second sections 32, 33 therefore are in frictional contact with the surface to be cleaned and are urged to deflect by the movement of the nozzle 1 over the surface. The frictional contact causes the first and second sections 32, 33 to deflect in one direction when moved in the first direction and to move in an opposite direction when moved in the second direction.

The nozzle 1, shown in FIG. 1, has the first array of flexible flaps 14 protruding from the base 3 between the suction aperture 11 and the front edge 4 of the base 3. The vertex 34 of each flexible flap 24 in the first array of flexible flaps 14 is proximate the front edge 4 of the base 3. The nozzle 1 also has the second array of flexible flaps 18 protruding from the base 3 between the suction aperture 11 and the rear edge 5 of the base 3. The vertex 34 of each flexible flap 26 in the second array of flexible flaps 18 is proximate the rear edge 5 of the base 3. The front wheel unit 12 is mounted on the base 3 of the nozzle 1 behind the first array of flexible flaps 14. The wheels 12*a*, 12*b* protrude from the first raised section 15, although alternative arrangements are envisaged.

Figure 6:
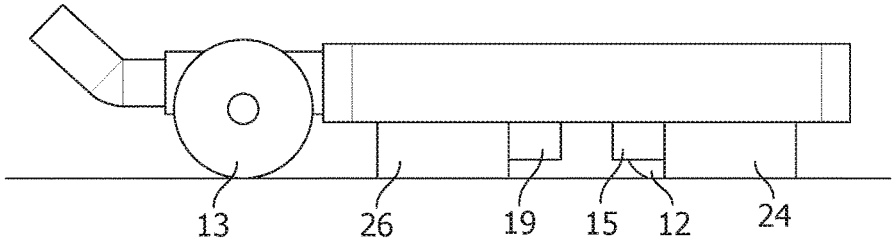
FIG. 6 shows a schematic side view of the nozzle for a vacuum cleaner.

The guide arrangement 10 helps the user maneuver the nozzle 1 over the surface to be cleaned. The guide arrangement 10 acts as a spacing mechanism. Referring to FIG. 6, the front and rear wheel units 12, 13 are in contact with the surface to be cleaned. The front and rear wheel units 12, 13 space the base 3 of the nozzle 1 for a vacuum cleaner from the surface to be cleaned.

The guide arrangement 10 defines the spacing between the base 3 of the nozzle 1 and the surface to be cleaned. As shown in FIG. 6, the height of the flexible flap 24, 26 from the base 3 of the nozzle 1 to the free end of the flexible flap 24, 26 is greater than the distance between the base 3 of the nozzle 1 and the surface to be cleaned.

Having the flexible flaps 24, 26 longer than the distance between the base 3 of the nozzle 1 and the surface to be cleaned allows the flexible flaps 24, 26 to have additional exposure to the floor. Therefore, on an uneven surface to be cleaned, the long flexible flap 24, 26 is able to maintain contact with the surface to be cleaned and so the nozzle 1 ensures a high performance by keeping the high underpressure in the nozzle 1.

The distance that the raised sections 15, 19 protrude from the base 3 is less than the spacing provided by the guide arrangement 10 between the base 3 and the surface to be cleaned so that the raised sections 15, 19 do not abut any protrusions on the surface to be cleaned. This ensures a good experience for the user as well as good performance from the nozzle 1.

Figure 7:
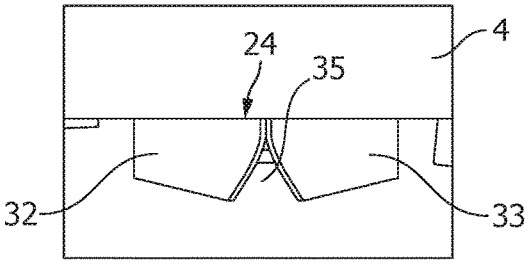
FIG. 7 shows a schematic front view of the flexible flap in its unbiased position.

Referring to FIG. 7, the flexible flap 24 is shown in an unbiased position. The first and second raised sections 32, 33 of the flexible flap 24 protrude downwardly from the base 3 of the nozzle 1. The opening 35 extends between the sections 32, 33. The first and section sections 32, 33 are in their undeformed state.

Figure 8:
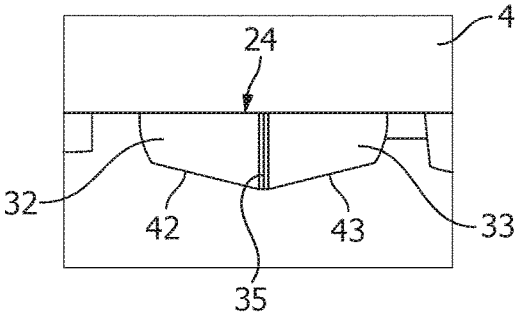
FIG. 8 shows a schematic front view of the flexible flap when the nozzle is moved in a first direction.

Referring to FIG. 8, the nozzle 1 for a vacuum cleaner is shown being moved in the first direction (that is, out of the page as shown in FIG. 8). The free ends 42, 43 of the first and second sections 32, 33 are in contact with the surface to be cleaned.

As the height of the flexible flap 24 is greater than the distance between the base 3 of the nozzle 1, the first and second sections 32, 33 of the flexible flap 24 are deformed. The free ends 42, 43 of the first and second sections 32, 33 of the flexible flap 24 are frictionally engaged with the surface to be cleaned. As the nozzle 1 is urged in the first direction, with the front edge 4 forming the leading edge, the first and second sections 32, 33 deform and are urged away from the front edge 4.

The movement of the first and second sections 32, 33 away from the front edge 4 of the base 3 urges the first and second sections 32, 33 towards each other. Therefore, the first and second sections 32, 33 are biased to locate against each other. With this movement, the opening 35 is closed, or minimized. The opening side edge 37 of the first section 32 is configured to abut the opening side edge 39 of the second section 33. The height of the flexible flap 24 and the diverging arc of the opening side edges 37, 39 towards the free ends 42, 43 of the flexible flap 24 are configured so that when the nozzle 1 is moved in the first direction the first and second sections 32, 33 flex rearwards towards the rear edge 5 of the base 3. The first and second sections flex due to the friction with the surface to be cleaned.

In an alternative embodiment, the first and second sections 32, 33 are restricted from continuing to deflect by the opening side edges 37, 39 abutting each other and restricting movement. The angular orientation of the first and second sections 32, 33 restricts movement of the first and second sections 32, 33 in the first direction. Although the arrangement of the flexible flap 24 itself acts as a stop to restrict movement it will be understood that an alternative stop arrangement may be used. When the opening 35 is closed or minimized, air flow through the gap is minimized or prevented. Air flow carrying detritus is guided along the first and second sections 32, 33 to the inlet 25 formed between adjacent flexible flaps 24. The detritus is then carried to the suction aperture 11.

Figure 9:
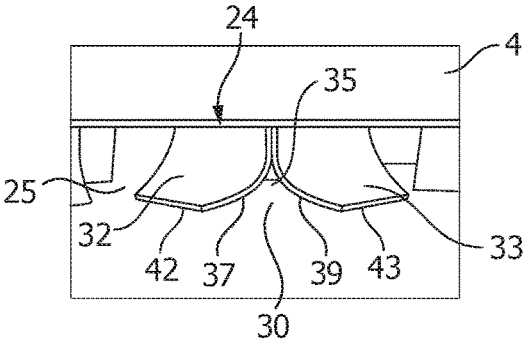
FIG. 9 shows a schematic front view of the flexible flap when the nozzle is moved in a second direction.

Referring to FIG. 9, the nozzle 1 for a vacuum cleaner is shown being moved in the second direction. The free ends 42, 43 of the first and second sections 32, 33 of the flexible flap 24 are in contact with the surface to be cleaned.

As the height of the flexible flap 24 is greater than the distance between the base 3 of the nozzle 1 and the surface to be cleaned, the first and second sections 32, 33 of the flexible flap 24 are deformed. The free ends 42, 43 of the first and second sections 32, 33 of the flexible flap 24 are frictionally engaged with the surface to be cleaned. As the nozzle 1 is urged in the second direction, with the front edge 4 forming the trailing edge, the first and second sections 32, 33 deflect and are urged towards the front edge 4.

The movement of the first and second sections 32, 33 towards the front edge 4 of the base 3 urges the first and second sections 32, 33 away from each other. Therefore, the first and second sections 32, 33 are biased away from each other. With this movement, the opening 35 is opened, or the area of the opening 35 is increased. The first and second sections 32, 33 are not restricted deflecting as they are biased away from each other.

When the opening 35 is biased into its open position, detritus retained in the recess 30 is able to pass through the opening 35 and to exit the recess 30. By opening the opening 35, detritus that is not removed from the surface to be cleaned is guided out from under the nozzle 1, so that the user can see the remaining detritus and guide the nozzle 1 over it again until it has been removed from the surface to be cleaned. The backwards movement also narrows the inlets 25 between adjacent flexible flaps 24 in the same array.

Figure 4:
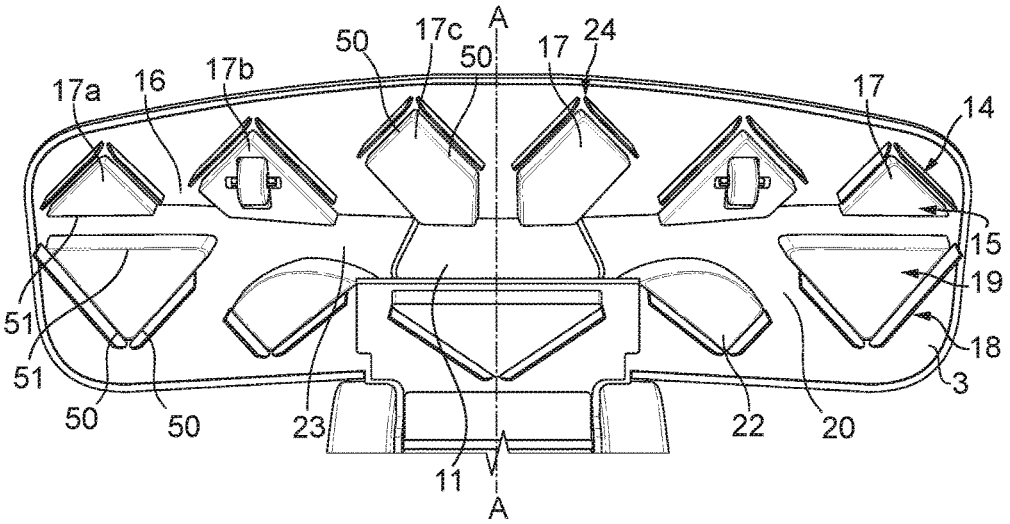
FIG. 4 shows a schematic bottom view of the base of the nozzle.

Referring to FIG. 4, the first and second raised sections 15, 19 of the base 3 are shown. The first raised section 15 is formed between the first array of flexible flaps 14 and the suction aperture 11. Each island 17 extends into a corresponding one of the recesses 30 defined by the flexible flaps 24. The height of each island 17 is less than the height of the corresponding flexible flap 24. Each island corresponds to the alignment of the corresponding flexible flap 24 and is spaced therefrom. Each island 17 has an outer face 50 extending parallel to the inner face 29 of the corresponding flexible flap 24. A rear face 51 of each island 17 defines the primary air channel 23.

In one embodiment, the flexible flap 24 is a rigid flap (not shown) which is flexibly mounted to the base by, for example, but not limited to, a hinge (not shown). The first raised section 15 is symmetrical about a line of symmetry. That is, the three islands 17 on the left portion of the base 3 are the mirror image of the three islands 17 on the right portion of the base 3. However, it will be understood that the number of islands may vary. The left portion of the base 3 comprises a distal island 17*a*, a medial island 17*b*, and a proximal island 17*c*, relative to the suction aperture 11. The right portion of the base has corresponding islands. Each island 17 has a generally triangular profile. However, parts of the triangular profile are omitted from at least the medial and proximal islands 17*b*, 17*c* to help define the air channels 16 formed between adjacent islands 17.

The air channels 16, acting as secondary air channels, are defined between adjacent islands 17.

Figure 5:
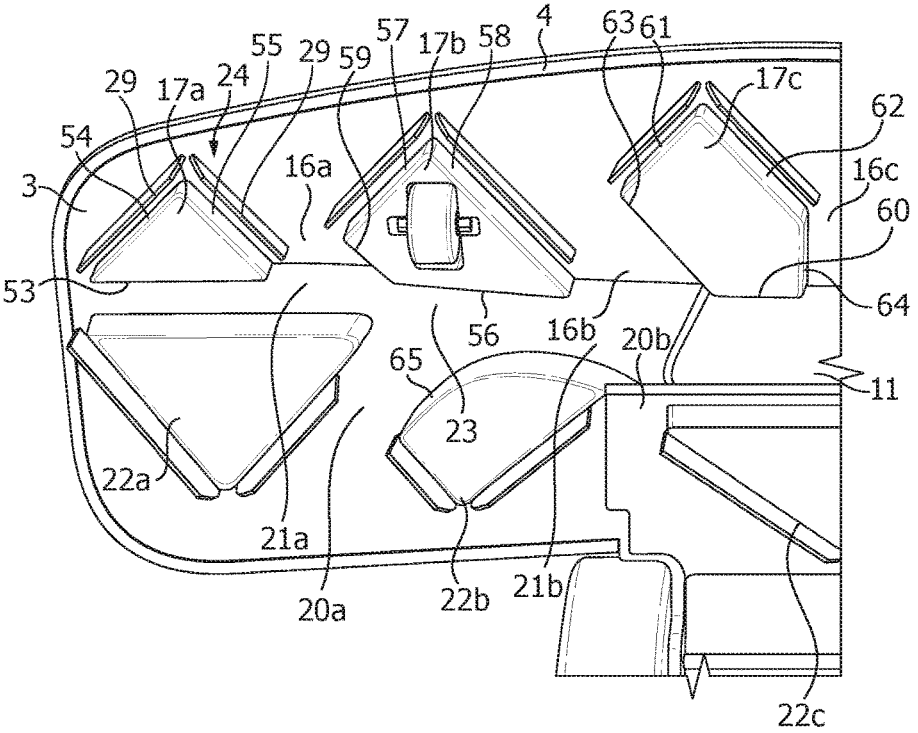
FIG. 5 shows a schematic bottom view of a left portion of the base of the nozzle.

Referring to FIG. 5 the distal island 17*a* of the first raised section 15 has a rear wall 53 which is distal to the front edge 4 of the base 3, a first sidewall 54 distal to the suction aperture 11 and a second sidewall 55 proximal to the suction aperture 11. The first and second sidewalls 54, 55 extend parallel to, but spaced from the inner face 29 of the corresponding flexible flap 24. The first and second sidewalls 54, 55 align with the flexible flap 24.

The medial island 17*b* of the first raised section 15 has a rear wall 56 which is distal to the front edge 4 of the base 3, a first sidewall 57 distal to the suction aperture 11 and a second sidewall 58 proximal to the suction aperture 11. The first and second sidewalls 57, 58 extend parallel to, but spaced from the inner face 29 of the corresponding flexible flap 24. The first and second sidewalls 57, 58 align with the flexible flap 24. A chamfered wall 59 extends between the first sidewall 57 and the rear wall 56. That is, the walls are truncated. The chamfered wall 59 is aligned with the second sidewall 55 of the distal island 17*a*. Therefore, adjacent islands 17*a*, 17*b* have aligned walls.

A first of the air channel 16*a* is defined between the distal and medial islands 17*a*, 17*b*. That is, the first air channel 16*a* is defined by the second sidewall 55 of the distal island 17*a* and the chamfered wall 59 of the medial island 17*b*. The second sidewall 55 and the chamfered wall 59 extend parallel to one another. The first sidewall 57 of the medial island 17*b* helps funnel air flow to the first air channel 16*a*.

The first air channel 16*a* extends at an acute angle to the primary air channel 23. The first air channel 16*a* forms a juncture 21*a* with the primary air channel 23. The first air channel 16*a* is configured to direct airflow at 45 degrees to air flow flowing in the primary air channel 23. However, it will be understood that the angle may vary. Air flow in the first air channel 16*a* combines with air in the primary air channel 23 to flow to the suction aperture 11.

The proximal island 17*c* of the first raised section 15 has a rear wall 60 which is distal to the front edge 4 of the base 3, a first sidewall 61 distal to the suction aperture 11 and a second sidewall 62 proximal to the suction aperture 11. The first and second sidewalls 61, 62 extend parallel to, but spaced from the inner face 29 of the corresponding flexible flap 24. The first and second sidewalls 61, 62 align with the flexible flap 24. A first chamfered wall 63 extends between the first sidewall 61 and the rear wall 60. The first chamfered wall 63 is aligned with the second sidewall 58 of the medial island 17*b*. Therefore, adjacent islands 17*b*, 17*c* have aligned walls. A second chamfered wall 64 extends between the second sidewall 62 and the rear wall 60. The second chamfered wall 64 is aligned with the second chamfered wall 64 of the opposing proximal island 17*c*. Therefore, adjacent islands 17*c*, 17*c* have aligned walls.

A second of the air channels 16*b* is defined between the medial and proximal islands 17*b*, 17*c*. That is, the second air channel 16*b* is defined by the second sidewall 58 of the medial island 17*b* and the first chamfered wall 63 of the proximal island 17*c*. The second sidewall 58 of the medial island 17*b* and the first chamfered wall 63 extend parallel to one another. The first sidewall 61 of the proximal island 17*c* helps funnel air flow to the second air channel 16*b*.

The second air channel 16*b* extends at an acute angle to the primary air channel 23. The second air channel 16*b* forms a juncture 21*b* with the primary air channel 23. The second air channel 16*b* is configured to direct airflow at 45 degrees to air flow flowing in the primary air channel 23. However, it will be understood that the angle may vary. Air flow in the second air channel 16*b* combines with air flow in the primary air channel 23 from the primary air channel 23 and the first air channel 16*a* to flow to the suction aperture 11.

A third of the air channels 16*c* is defined between the two proximal islands 17*c*, 17*c*. That is, the third air channel 16*c* is defined by the second chamfered walls 64. The second chamfered walls 64 extend parallel to one another. The second sidewalls 62 of the proximal island 17*c* help funnel air flow to the third air channel 16*c*. Airflow in the third air channel 16*c* flows directly to the suction aperture 11.

The first raised section 15 is configured such that the secondary air channels 16 located between adjacent islands 17 in the first raised section are offset from the secondary air channels 20 located between adjacent islands 22 in the secondary air channels 20. The configuration of the offset islands 17, 22 prevents air flow and detritus that enters the nozzle 1 through one secondary air channel 16, 20 having a clear line of sight to another secondary air channel 16, 20 through which the air flow or detritus may be ejected. The offset configuration of the islands 17, 22 prevents air flow and detritus from exiting the nozzle 1 because air flow and detritus is either transported straight to the suction aperture 11 or impinges another island 17, 22 before being sucked into the suction aperture 11.

When the nozzle is moved in the first direction the first and second sections 32, 33 of the flexible flap 24 deflect away from the front edge 4 of the base 3 and the opening 35 between the sections 32, 33 is closed or narrowed. In this case, most of the airflow is directed along the outer face 28 of the flexible flap 24 and into the air channels 16 between adjacent protruding islands 17. The island 17 protruding into the recess 30 minimizes the area into which the air can flow which allows the airflow to maintain a higher velocity and decreases the rise in pressure in the recess 30 of the flexible flap 24. This allows the nozzle 1 to maintain a high performance and high negative pressure. The higher air speed provided also aids in removing detritus that is in the recess 30.

When the nozzle is moved in the second direction the first and second sections 32, 33 of the flexible flap 24 deflect towards the front edge 4 of the base 3 and the opening 35 between the sections 32, 33 is opened or widened. In this case, the airflow is directed through the opening 35 and between the inner face 29 of the flexible flap 24 and the island 17. The island 17 protruding into the recess 30 minimizes the area into which the air can flow which allows the airflow to maintain a higher velocity and decreases the rise in pressure in the recess 30 of the flexible flap 24. The increased air flow past the island 17 increases the velocity of air flow and so more detritus may be removed from the recess 30. The opened or widened opening 35 also allows any detritus that has not been removed from the surface to be cleaned to exit the nozzle 1 and be viewed by the user, indicating to the user that the nozzle 1 should be moved over this part of the surface again.

Referring back to FIG. 4, the second raised section 19 is formed between the second array of flexible flaps 18 and the suction aperture 11. Each island 22 of the second raised section 19 extends into a corresponding one of the recesses 30 defined by the flexible flaps 26. The height of each island 22 is less than the height of the corresponding flexible flap 26. Each island 22 corresponds to the alignment of the corresponding flexible flap 26 and is spaced therefrom. Each island 22 has an outer face 50 extending parallel to the inner face 29 of the corresponding flexible flap 26. A rear face 51 of each island 22 defines the primary air channel 23.

Referring again to FIG. 5, the second raised section 19 is symmetrical about a line of symmetry. However, it will be understood that the number of islands 22 may vary. The left portion of the base 3 comprises a rear distal island 22*a* and a rear medial island 22*b*, relative to the suction aperture 11. A rear proximal island 22*c* is disposed midway along the base 3. The right portion of the base 3 has corresponding islands. Each island 22 has a generally triangular profile. However, parts of the triangular profile are omitted from at least the medial island 22*b* to help define the air channels 20 formed between adjacent islands 17. The air channels 20, acting as secondary air channels, are defined between adjacent islands 22. A fourth air channel 20*a* is formed between the rear distal island 22*a* and rear medial island 22*b*. A fifth air channel 20*b* is formed between the rear medial island 22*b* and rear proximal island 22*c*. The configuration of the islands 22 and the secondary air channels 16 of the second raised section 19 is generally the same as that of the first raised section 16 and so a detailed description will be omitted herein.

Although in the above described islands, the chamfered walls extend to vertices, it will be understood that they may be formed with a rounded profile. The rear medial island 22*b* has an arcuate wall 65. The arcuate wall 65 provides a gradual increase in cross-sectional area and promotes a uniform pressure throughout the air passages in the nozzle 1. The arcuate and chamfered walls act to minimize sharp corners and so reduce turbulence.

It will be understood that the configuration of each island are not limited to the description above and alternative embodiments are envisaged. For example, the edges of the islands may all be arcuate, straight, or a mixture of the two and may not run parallel to each other. Furthermore, the corners of the islands may be rounded to reduce the amount of turbulence created. It will be understood that the number and shape of the islands described represent only one embodiment of the nozzle 1 and a combination of any number and/or shape of islands may be used.

The first and second sections 32, 33 of the flexible flaps 24, 26 are aligned with the edges of the first and second sidewalls of the islands 17, 22. This helps to prevent the distal edges of the flexible flaps 24, 26 from being a source of turbulence in the guide channels.

By combining the air flows at an acute angle it is possible to minimize the turbulence created due to the mixing of airflows and detritus. This helps to minimize noise and to maximize the performance of the nozzle.

The primary air channel 23 extends from the periphery of the base 3 to the suction aperture 11. However, it will be understood that the arrangement of the primary air channel 23 may vary. One primary air channel 23 is formed in the left portion of the base 3 and another primary air channel 23 is formed in the right portion of the base 3. The primary air channels 23 correspond to each other and so only one will be described herein. The primary air channel 23 is divided into parts with each part extending between secondary air channels 16, 20. At the juncture 21 with each secondary air channels 16, 20 the flow area of the primary air channel 23 increases to correspond to the combined flow areas of the preceding part of the primary air channel 23 and the corresponding secondary air channels 16, 20. Therefore, the flow area of the primary air channel 23 increases towards the suction aperture 11.

The increase in cross-sectional area of the primary air channel 23 is proportional to the cross-sectional area of the secondary air channel 16, 20 that meets the primary air channel 23 at the juncture 21. However, it will be understood that the increase in flow area may not directly correspond. The increase in flow area of the primary air channel 23 reduces the rise in pressure in the primary air channel 23 by providing an increased area for the increased mass flow to travel through.

Although in the present embodiment the embodiments of air channel arrangements are described in combination with the flexible flap arrangement, it will be understood that alternative arrangements are envisaged. For example, it will be understood that the air channel arrangements may be used in a nozzle with the flexible flaps omitted. Alternatively, the flexible flaps may be replaced by bristles or other flexible elements. Furthermore, the arrangement of the flaps may differ. In another embodiment, the air channels may be configured to vary the flow area at the juncture of two or more air channels, but the juncture of the air channels may be a transverse junction. Alternatively, air channels may impinge with the primary air channel at an acute angle at the juncture of the air channels to promote laminar flow, but the flow area of the primary air channel may not vary. It has been found that the combination of the air channels impinging with the primary air channel at an acute angle and increasing the flow are of the primary air channel at the juncture together help to promote laminar flow. This helps to maximize flow velocity through the air channels and helps to minimize noise levels.

Figure 10:
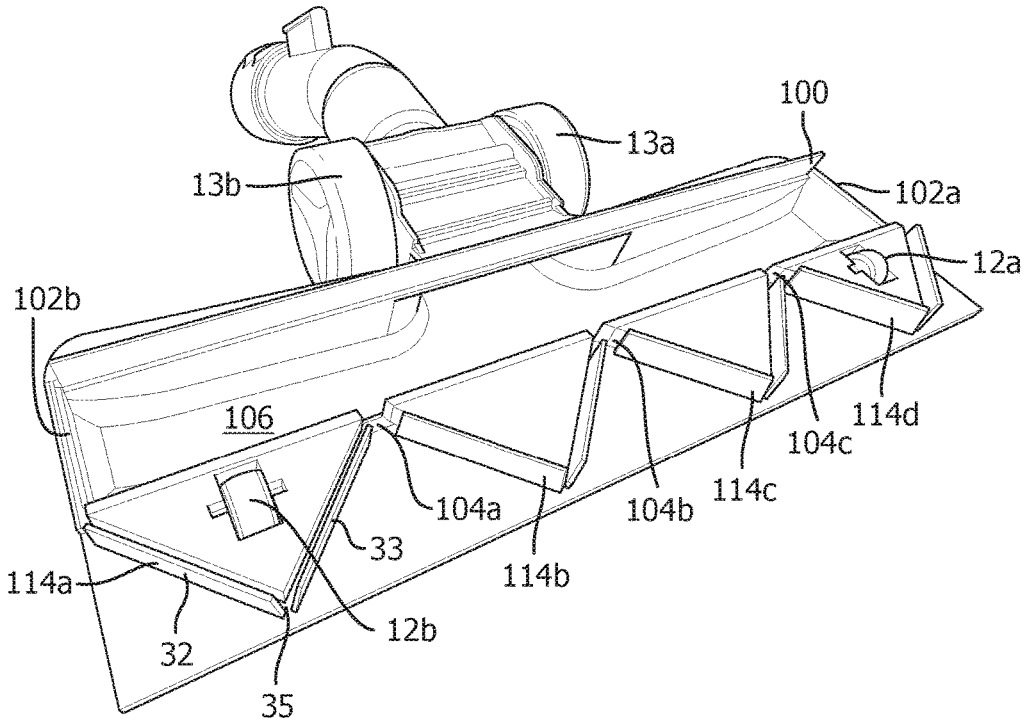
FIG. 10 shows a schematic bottom view of a preferred embodiment of a nozzle for a vacuum cleaner.

In one embodiment of this invention as shown in FIG. 10, the zig-zag nozzle is modified in order to derive higher efficiency levels i.e. DPU ratings for various floor types as defined in the EU Commission's Delegated Regulation (EU) No 665/2013 on energy labelling of vacuum cleaners. In this embodiment, the zig-zag nozzle is modified to only have the zig-zag elements 114*a*, 114*b*, 114*c*, 114*d* in the front, while the zig-zag elements in the rear side are replaced by a single strip or flap 100 of a flexible material like rubber extending over the whole length of the rear side. Further, the suction channel 106 formed in between the rear and front sides is made wider (compared to a usual 10 mm it is now between 20 and 45 mm, and preferably 35 mm), and the sides 102*a*, 102*b* of the suction channel 106 are fully opened. Overall, the zig-zag front elements 114*a*-114*d* will be able to collect detritus in the front movement, while the rear strip 100 and the opened ends 102*a*, 102*b* of the suction channel 106 will enable a higher concentration of flow at the edges for better edge/plinth/crevice cleaning.

Aim of this nozzle embodiment is to obtain an at least 111% (or 1.11) DPU hard floor rating and that it still removes coarse particles of the floor (macaroni, rice etc.). A 111% hard floor DPU rating is needed to receive an A label for cleaning performance on hard floors. 111% is only possible when dust is removed out of the crevice outside the nozzle width (when cleaned underneath the nozzle a performance of about 100% is made). The coarse dirt pick up is to satisfy the consumer.

To achieve a DPU of over 111%, the nozzle according to the present embodiment has the following features:

- Large openings 102*a*, 102*b* at the sides of the nozzle having a width between 20 and 45 mm and a height between 4 and 10 mm. Preferably the openings are 35 mm (width)×7 mm (height).
- The back of the nozzle is closed to the floor with a flap 100.
- The front of the nozzle has only 3 openings 104*a*, 104*b*, 104*c*. The total area of all openings should be between 100-400 $mm^2$, but preferably around 150-200 $mm^2$. With the idea that a bean or pea is about 7 mm, we defined the opening size to be 7 mm wide. Considering the height of about 7-10 mm that is defined by rubber flap height, only 3-6 apertures (preferably 3) are allowed. With high suction power canisters, this area, and thus the number of openings, is allowed to increase.

Because of the small amount of openings 104*a*, 104*b*, 104*c* in the front, and the closed rubber flap 100 at the back, almost all the air enters the nozzle from the sides 102*a*, 102*b*. This airstream from the sides removes dust out of the crevice outside the width of the nozzle.

Also, it will be appreciated by anyone ordinarily skilled in the art that the invention according to any embodiment of this invention is suitable for any type of surface/floor cleaner including common canister or upright or robotic cleaners. It can further be used in window cleaners etc. In a robotic vacuum cleaner, the nozzle is integrated within the bottom of the robotic vacuum cleaner, the nozzle's base would be the bottom of the robotic vacuum cleaner, and the edge would be an edge of the bottom of the robotic vacuum cleaner or a nozzle part thereof. The claims should thus be read in a manner that includes the application of the invention to robotic vacuum cleaners in which the nozzle is integrated into or part of the bottom of the robotic vacuum cleaner.

It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalization thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A nozzle for a vacuum cleaner, the nozzle comprising:

a base having an edge, a suction aperture in the base, and at least one flexible flap protruding from the base between the edge and the suction aperture, the flexible flap having first and second sections separable by an opening, wherein the first and second sections are arranged to be urged towards each other when the nozzle is moved in a first direction in which the edge is a leading edge to close the opening or tend the opening towards closing, and to be urged away from each other when the nozzle is moved in a second direction in which the edge is a trailing edge to open the opening or to further open the opening.

2. A nozzle according to claim 1, wherein the first and second sections of the flexible flap are configured to guide detritus towards the suction aperture when the nozzle is moved in the first direction.

3. The nozzle according to claim 1, wherein the flexible flap is configured to define a recess on a rear side facing the suction aperture and, optionally, wherein a raised section of the base is received in the recess, spaced from the flexible flap.

4. The nozzle according to claim 1, wherein the first and second sections diverge away from each other from the edge.

5. The nozzle according to claim 4, wherein the first and second sections tend away from a vertex of the flexible flap, the opening being defined at the vertex.

6. The nozzle according to claim 1, further comprising a guide arrangement configured to space the base from a surface to be cleaned, wherein the height of the at least one flexible flap from the base to a distal end of the flexible flap is greater than the spacing provided by the guide arrangement so that, during use, the at least one flexible flap is in contact with the surface to be cleaned.

7. The nozzle according to claim 1, comprising an array of flexible flaps, wherein adjacent flexible flaps are spaced from each other.

8. The nozzle according to claim 1, wherein the base has a primary air channel configured to guide detritus towards the suction aperture and a secondary air channel having a juncture with the primary air channel which is configured to guide detritus from the edge of the base to the primary air channel.

9. The nozzle according to claim 8, wherein the primary air channel has a first part and a second part, the second part being defined between the suction aperture and the juncture of the first part, and wherein the flow area of the second part of the primary air channel is greater than the flow area of the first part.

10. The nozzle according to claim 8, wherein, during use, the secondary air channel is configured to guide a flow of air along the secondary air channel to impinge with a flow of air along the primary air channel at an acute angle at the juncture of the primary and secondary air channels to promote laminar flow.

11. A nozzle as claimed in claim 1, comprising:

an array of pairs of flexible flaps each having said first and second sections at a front end of the nozzle, openings being present between adjacent pairs of flexible flaps, and a flexible strip at a rear end of the nozzle.

12. A nozzle as claimed in claim 11, having no more than 7 pairs of flexible flaps and no more than 6 openings.

13. A nozzle as claimed in claim 12, having 4 pairs of flexible flaps and 3 openings.

14. A nozzle as claimed in claim 11, having a suction channel width between 20 and 45 mm, preferably 35 mm, and openings at both ends of the suction channel having a width between 20 and 45 mm, preferably 35 mm, and a height between 4 and 10 mm, preferably 7 mm.

15. A vacuum cleaner comprising the nozzle according to claim 1.

* * * * *